US010184361B2

(12) United States Patent
Hoglund et al.

(10) Patent No.: US 10,184,361 B2
(45) Date of Patent: Jan. 22, 2019

(54) COMBUSTION ENGINE WITH PNEUMATIC VALVE RETURN SPRING

(71) Applicant: FREEVALVE AB, Angelholm (SE)

(72) Inventors: Anders Hoglund, Munka Ljungby (SE); Urban Carlson, Helsingborg (SE); Christian Koenigsegg, Vejbystrand (SE); Lars Ivarsson, Eket (SE)

(73) Assignee: FREEVALVE AB, Angelholm (SE)

( * ) Notice: Subject to any disclaimer, the term of this patent is extended or adjusted under 35 U.S.C. 154(b) by 110 days.

(21) Appl. No.: 15/304,616

(22) PCT Filed: Apr. 15, 2015

(86) PCT No.: PCT/SE2015/050437
§ 371 (c)(1),
(2) Date: Oct. 17, 2016

(87) PCT Pub. No.: WO2015/160304
PCT Pub. Date: Oct. 22, 2015

(65) Prior Publication Data

US 2017/0037750 A1 Feb. 9, 2017

(30) Foreign Application Priority Data

Apr. 17, 2014 (SE) ..... 1450470

(51) Int. Cl.
*F01L 1/46* (2006.01)
*F01L 9/02* (2006.01)
*F01L 3/08* (2006.01)

(52) U.S. Cl.
CPC ..... *F01L 1/465* (2013.01); *F01L 3/08* (2013.01); *F01L 9/02* (2013.01)

(58) Field of Classification Search
CPC ... F01L 1/465; F01L 3/08; F01L 3/085; F01L 3/10; F01L 9/026
(Continued)

(56) References Cited

U.S. PATENT DOCUMENTS 3,120,221 A 2/1964 Jim
5,586,529 A * 12/1996 Vallve ..... F01L 1/465 123/188.17
(Continued)

FOREIGN PATENT DOCUMENTS

DE 2949413 A1 6/1981
DE 42 14 839 A1 11/1993
(Continued)

OTHER PUBLICATIONS

International Search Report, dated Jul. 3, 2015, from corresponding PCT application.
(Continued)

*Primary Examiner* — Jorge Leon, Jr.
(74) *Attorney, Agent, or Firm* — Young & Thompson

(57) ABSTRACT

A combustion engine includes an engine valve arranged to selectively open/close a combustion chamber of the engine, a cylinder head adjacent the combustion chamber, arranged to guide a valve stem of the engine valve, the engine valve being axially displaceable relative to the cylinder head between the combustion chamber closed position and the combustion chamber fully opened position, and a valve spring retainer connected to the valve stem. The valve spring retainer partly delimits a gas spring volume, which is in fluid communication with an adjacent gas volume via a port when the engine valve is in the combustion chamber closed position, and which is separated from the adjacent gas volume when the engine valve is in the combustion chamber fully open position, the port being open during at least 25%
(Continued)

of the maximal stroke of the engine valve and being closed due to a displacement of the engine valve.

15 Claims, 10 Drawing Sheets

(58) Field of Classification Search
USPC ..... 123/90.13, 90.14, 90.66, 90.67
See application file for complete search history.

(56) References Cited

U.S. PATENT DOCUMENTS

| | | | | |
|---|---|---|---|---|
| 6,745,738 | B1 * | 6/2004 | Bosscher | F01L 1/462 123/90.12 |
| 8,763,571 | B2 * | 7/2014 | Gilbert | F01L 9/026 123/53.5 |
| 2003/0094149 | A1 * | 5/2003 | Hall | F01L 9/026 123/90.11 |
| 2004/0164259 | A1 * | 8/2004 | Langham | F01L 1/462 251/63.5 |
| 2006/0081202 | A1 * | 4/2006 | Verner | F01L 3/08 123/90.11 |
| 2009/0007863 | A1 * | 1/2009 | Matsuda | F01L 1/022 123/90.14 |
| 2011/0030630 | A1 * | 2/2011 | Rioli | F01L 1/465 123/90.14 |
| 2015/0247430 | A1 * | 9/2015 | Thomason | F01L 1/462 123/90.14 |

FOREIGN PATENT DOCUMENTS

| | | | | |
|---|---|---|---|---|
| DE | 4214839 | A1 * | 11/1993 | F01L 1/143 |
| EP | 0824180 | A1 | 2/1998 | |
| FR | 2 364 328 | A1 | 4/1978 | |
| JP | 6363512 | U | 4/1988 | |
| WO | 2009087441 | A1 | 7/2009 | |

OTHER PUBLICATIONS

Oct. 20, 2017, EP communication issued for related EP application No. 15779539.4.

* cited by examiner

COMBUSTION ENGINE WITH PNEUMATIC VALVE RETURN SPRING

TECHNICAL FIELD OF THE INVENTION

The present invention relates in general to a combustion engine suitable for powering a vehicle, such as a car or a truck, a boat etc. or a machine such as an electric power generation unit or the like. The combustion engines concerned are camshaft free piston engines, which are also known under the concept "engines with free valves". The present invention relates in particular to a combustion engine comprising a first controllable engine valve arranged to selectively open/close a combustion chamber of a combustion engine, a cylinder head that is adjacent the combustion chamber, and that is arranged to guide a valve stem of the engine valve, the engine valve being axially displaceable in relation to said cylinder head between a the combustion chamber closed position and a the combustion chamber fully opened position, and a valve spring retainer that is connected to said valve stem.

BACKGROUND OF THE INVENTION AND STATE OF THE ART

In a camshaft free combustion engine, a pressure fluid, such as a liquid or a gas, is used to achieve a displacement/opening of one or more engine valves. This means that the camshafts, and related equipment, that conventional combustion engines use to open engine valves to let air in and let exhaust fumes out, have been replaced by a less volume-demanding and more controllable system. However, it shall be pointed out that the present invention may also be used in a combustion engine comprising conventional cam shafts.

The combustion engine comprises conventionally a strong valve spring in the shape of a coil spring adapted to return the respective engine valve to a closed position of the combustion chamber. When designing these coil springs, several factors need to be weighed to obtain an adequate closing at different engine speeds and to ensure that the engine valve does not unintentionally open at the wrong occasion. In reality, the coil spring must be designed for the most extreme situations, which in most operational conditions entail that the valve spring force is unnecessary large, which in turn entail unnecessary power consumption. Thereto, the spring force of a traditional valve spring has a linear increase.

Pneumatic valve springs are, for instance, known from Formula 1 engines, in which conventional metal coil springs are not fast enough for the extremely high engine speeds used. These solutions includes an oxygen free gas as a gas spring and are thereto expensive and require complicated sealing for preventing the gas from leaking out or air/oil from leaking in. From a cost perspective, it is not justifiable to use the technique used in Formula 1 engines in a combustion engine for a passenger car or a heavy vehicle.

In combustion engines according to the present invention, pneumatics as well as hydraulics are used for its operation, and in these systems it is desirable that the hydraulic fluid is present in the gas that usually is constituted by air, for lubricating, cooling, and sealing purposes. The term hydraulic in this disclosure is meant to mean engine oil if nothing contrary is stated.

BRIEF DESCRIPTION OF THE OBJECT OF THE INVENTION

The aim of the present invention is to set aside the abovementioned drawbacks and shortcomings of the previously known combustion engines and to provide an improved combustion engine. A main object of the invention is to provide an improved combustion engine of the initially defined type, in which the energy needed to open an engine valve is less than for previously known combustion engines.

Another object of the present invention is to provide a combustion engine, in which the return spring force acting against the engine valve has increasing potential derivative at high and increasing engine valve lift in order to prevent the contact between the engine valve stem and the depressor to be lost.

Another object of the present invention is to provide a combustion engine, which comprises a pneumatic valve spring that admits hydraulic liquid to be present in the gas used, without being negatively effected.

Another object of the present invention is to provide a combustion engine that entails an adjustable return-spring force of a pneumatic valve spring.

BRIEF DESCRIPTION OF THE INVENTION

According to the invention, at least the main object is achieved by way of the initially defined combustion engine having the features defined in the independent claim. Preferred embodiments of the present invention are further defined in the subsequent dependent claims.

According to the present invention, a combustion engine of the initially defined type is provided that is characterized in that the valve spring retainer partly delimit a gas spring volume, which is in fluid communication with an adjacent gas volume via a port when the engine valve is in the combustion chamber closed position, and which is separated from the adjacent gas volume when the engine valve is in the combustion chamber fully open position, said port being open during at least 25 percentage of the maximal stroke of the engine valve and being closed due to a displacement of the engine valve.

Thus, the present invention is based on the insight that by admitting the gas spring volume to be in fluid communication with an adjacent gas volume when the engine valve is closed the pre tension pressure of the pneumatic valve spring can be adjusted at the same time as the pneumatic valve spring is only used during high engine valve lifts.

According to a preferred embodiment of the present invention, comprises a lead through, which is arranged to guide the valve stem of the engine valve, said valve spring retainer and a cylinder shaped sleeve that extends from the valve spring retainer forming a valve spring cover, the cylinder shaped sleeve of the valve spring cover being telescopically displaceable in relation to said lead through, radially outside the lead through, and the valve spring over and the lead through delimiting said gas spring volume. This entail that liquid that has possibly been accumulated in the gas spring volume is automatically evacuated therefrom when the engine valve is closed.

According to a preferred embodiment of the present invention, the cylinder shaped sleeve of the valve spring cover, close to the free end thereof, presents said port for admitting fluid communication between the gas spring volume and the adjacent gas volume when the engine valve is in the combustion chamber closed position. Thereby obtaining a direct correlation between the displacement of the engine valve and the closure of the fluid communication between the gas spring volume and the adjacent gas volume.

According to a preferred embodiment the combustion engine comprises a cylinder head chamber that is part of a closed pressure fluid circuit, and that is partly delimited by said cylinder head, the valve spring cover being arranged in said cylinder head chamber. Thereby using the gas used in the closed pressure fluid circuit, entailing less demand for sealing.

Preferably the combustion engine comprises a position sensor that comprises said valve spring cover and a coil, the valve spring cover being telescopically displaceable in relation to the coil, radially inside the coil. Due to the fact that the valve spring cover is connected to the engine valve an accurate determination/control of the position of the engine valve is admitted.

Further advantages with and features of the invention are evident from the remaining dependent claims and from the following detailed description of preferred embodiments.

BRIEF DESCRIPTION OF THE DRAWINGS

A more thorough understanding of the abovementioned and other features and advantages of the present invention will be evident from the following detailed description of preferred embodiments with reference to the enclosed drawings, on which.

DETAILED DESCRIPTION OF PREFERRED EMBODIMENTS

Figure 1:
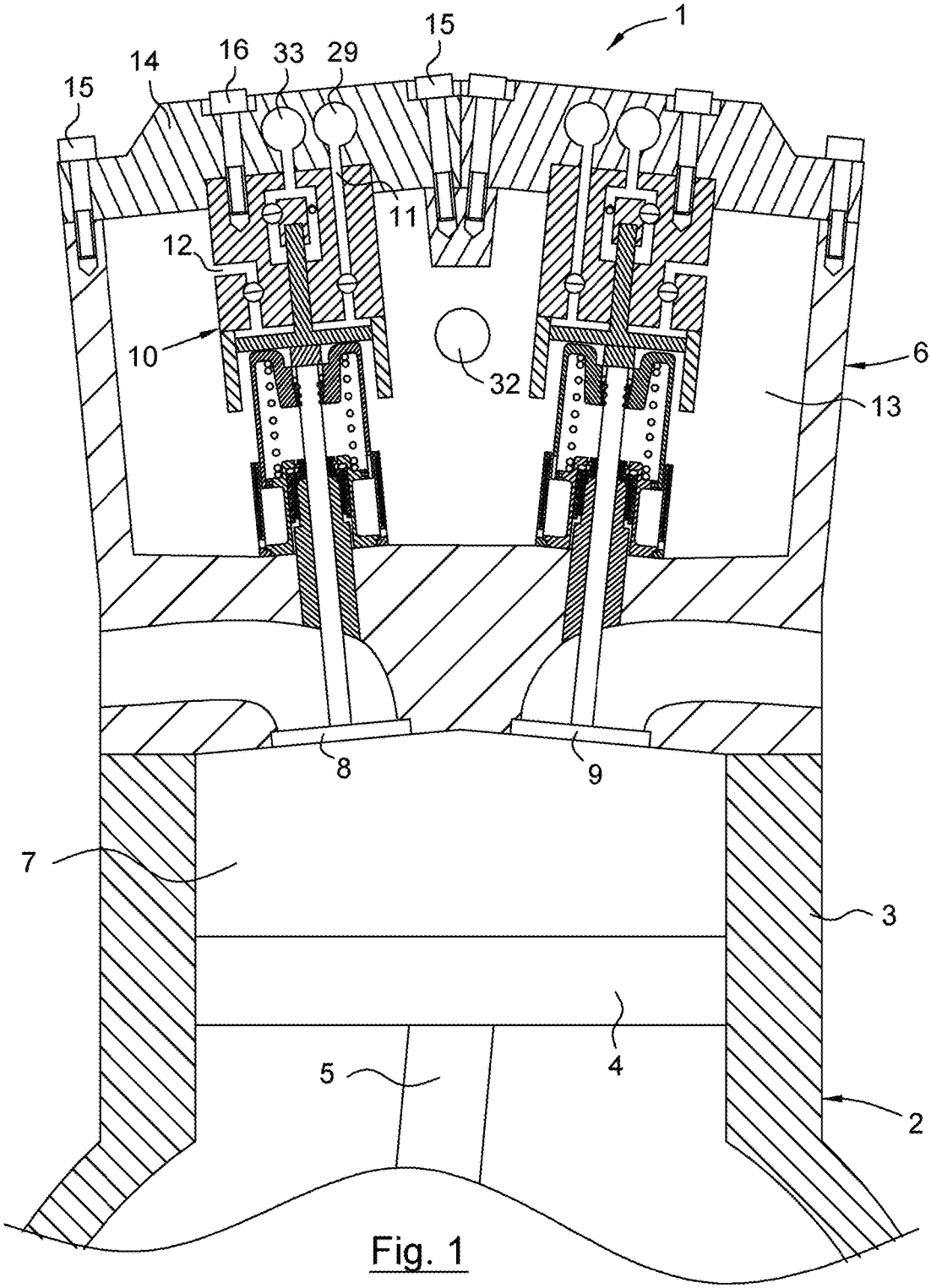
FIG. 1 is a schematic cross-sectional side view of a part of a combustion engine.

Reference is initially made to FIG. 1 that is a schematic illustration of a part of an inventive combustion engine, generally designated 1. The combustion engine 1 comprises a cylinder block 2 with at least one cylinder 3. Said cylinder block 2 generally comprises three or four cylinders 3. In the shown embodiment one cylinder 3 is described, it should nevertheless be realized that the equipment described below in relation to the shown cylinder 3 is preferably applied to all of the cylinders of the combustion engine 1, in the embodiment the combustion engine comprises several cylinders.

Furthermore, the combustion engine 1 comprises a piston 4 that is axially displaceable in said cylinder 3. The movement, axial displacement forth and back, of the piston 4 is transferred on a conventional manner to a connection rod 5 connected with the piston 4, the connection rod 5 in turn is connected with and drives a crank shaft (not shown) in rotation.

The combustion engine 1 also comprises a cylinder head 6 that together with said cylinder 3 and said piston 4 delimits a combustion chamber 7. In the combustion chamber 7 the ignition of a mix of fuel and air occurs in a conventional manner and is not further described herein. The cylinder head 6 comprises a controllable first engine valve 8, also known as a gas exchange valve. In the shown embodiment, the cylinder head also comprises a controllable second engine valve 9. Said first engine valve 8 constitutes, in the shown embodiment, an inlet valve that is arranged to selectively open/close for supply of air to the combustion shown embodiment an air outlet valve, or exhaust valve that is arranged to selectively open/close for evacuation of exhausts form the combustion chamber 7.

The combustion engine 1 further comprises in the preferred embodiment a first valve actuator 10 that is operatively connected to said first engine valve 8 and that is arranged in a closed pressure fluid circuit of the combustion engine 1. The first valve actuator 10 comprises at least one inlet opening 11 for pressure fluid and at least one outlet opening 12 for pressure fluid. The pressure fluid is a gas or a gas mixture, preferably air or nitrogen gas. Air has the advantage that it is easy to change the pressure fluid or to supply more pressure fluid if the closed pressure fluid circuit leak, and nitrogen gas has the advantage that it lacks oxygen, which prevents oxidation of other elements.

In the case the combustion engine 1 comprises several valve actuators these are arranged in parallel with each other in said closed pressure fluid circuit. Each valve actuator can be operatively connected to one or more engine valves, for example the combustion engine may comprise two inlet valves 8 which are jointly driven by the same valve actuator 10, however it is preferred that each valve actuator drives one engine valve each to achieve the greatest possible control of the operation of the combustion engine 1.

The description below regarding the combustion engine 1, will only describe one engine valve 8 and one valve actuator 10, but it should be realized that if nothing else is said, the corresponding is also true for all engine valves and valve actuators.

The combustion engine 1 also comprises a cylinder head chamber 13 that forms part in said closed pressure fluid circuit and that is delimited by said cylinder head 6 and a cylinder head mantle 14. In the shown embodiment the cylinder head mantle 14 is divided into two parts, which parts are separately connectable to and releasable from the cylinder head 6 by means of screws 15. The cylinder head chamber 13 preferably presents a volume of the order of 3-10 liter, typically on the order of 5-6 liter. In an alternative embodiment, only one cylinder head mantle 14 is present that, together with the cylinder head 6, alone delimit the cylinder head chamber 13.

The at least one outlet opening 12 of the valve actuator 10 is in fluid communication with the cylinder head chamber 13, i.e. the pressure fluid leaving the valve actuator 10 via said at least one outlet opening 12 flows out in the cylinder head chamber 13. In the case the combustion engine 1 comprises several valve actuators, the outlet openings for pressure fluid of all valve actuators preferably mouth in the same cylinder head chamber.

Preferably, the whole of the valve actuator 10 is arranged in said cylinder head chamber 13, and it is also preferred that the valve actuator 10 is releasably connected to said cylinder head mantle 14, for example by a bolt 16, or similar attachment means. In this embodiment, the valve actuator 10 accordingly "hangs" in the cylinder head mantle 14 without being in contact with the cylinder head 6. If the valve actuator 10 should be in contact with both the cylinder head mantle 14 and the cylinder head 6, a construction wise disadvantageous tolerance chain is achieved.

Figure 2:
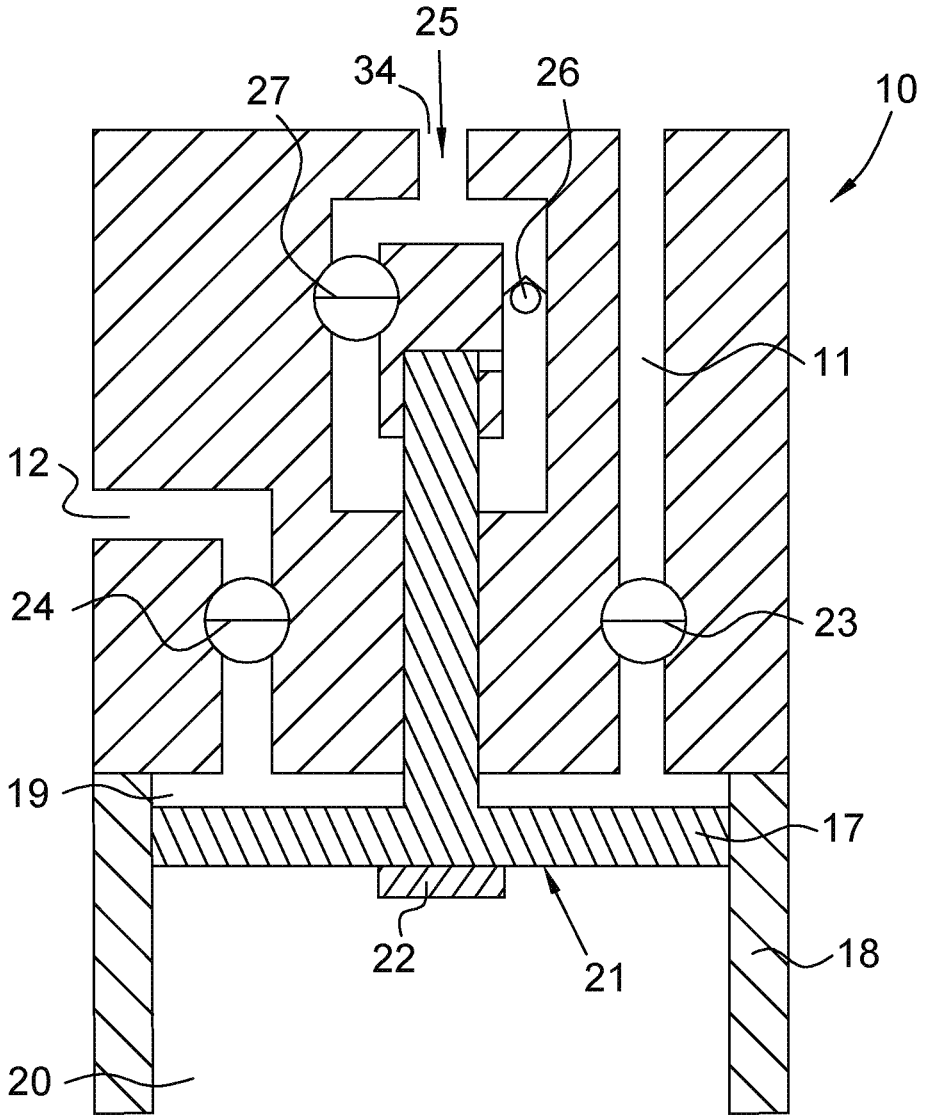
FIG. 2 is a schematic cross-sectional side view of a valve actuator.

Reference is now made to the FIG. 2, which disclose a schematic illustration of the valve actuator 10.

The valve actuator 10 comprises an actuator piston disc 17 and an actuator cylinder 18 delimiting a downward open cylinder volume. The actuator piston disc 17 divides said cylinder volume in a first upper part 19 and a second lower part 20 and is axially displaceable in said actuator cylinder 18. The actuator piston disc 17 forms part of an actuator piston or driver, generally designated 21, that is arranged to contact and drive said engine valve 8. The actuator piston 21 further comprises means 22 for play elimination in the axial direction in relation to said engine valve 8. The play eliminating means 22 is preferably hydraulic, and assures that when the actuator piston disc 21 is in its upper dead position, the actuator piston 21 remains in contact with the first engine valve 8 when it is closed, for the purpose of correcting for assembly tolerances, heat expansion, etc. Accordingly, the axial length of the actuator piston 21 is adjusted automatically by means of the play eliminating means 22.

The second part 20 of the cylinder volume of the valve actuator 10 is in fluid communication with said cylinder head chamber 13. This way, it is guaranteed that the same pressure acts on the actuator piston disc 17 from the first part 19 of the cylinder volume and from the second part 20 of the cylinder volume, respectively, when the actuator piston 21 is in the upper dead position. By that, the sealing between the actuator piston disc 17 and the actuator cylinder 18 is not critical, and some leakage can be allowed, which entail that a more simple and cheap sealing arrangement can be used, and in the resting position, the actuator piston disc is not affected by changes in the low pressure level.

The valve actuator 10 comprises a controllable inlet valve 23 that is arranged to open/close the inlet opening 11, a controllable outlet valve 24 that is arranged to open/close the outlet opening 12, a hydraulic circuit, generally designated 25, that in turn comprises a non-return valve 26 arranged to allow filling of the hydraulic circuit 25, and a controllable emptying valve 27 arranged to control the emptying of the hydraulic circuit 25. It should be pointed out that the valves in the valve actuator 10 are schematically depicted and can for example be constituted by sliding valves, seat valves, etc. Furthermore, several of the abovementioned controllable valves may be constituted by a single body. Each valve can further be directly or indirectly electrically controlled. With directly electrically controlled is meant that the position of the valve is directly controlled by, for example, an electromagnetic device, and with indirect electrically controlled is meant that the position of the valve is controlled by a pressure fluid that in turn is controlled by, for example, an electromagnetic device.

In order to obtain a displacement of the actuator piston disc 17 downwards, in order to open the engine valve 8, the inlet valve 23 is opened to allow filling of pressure fluid with a high pressure in the upper part 19 of the cylinder volume. When the actuator piston 21 is displaced downwards, the non-return valve 26 of the hydraulic circuit 25 is opened and hydraulic fluid is sucked in and replaces the volume that the actuator piston 21 leaves. Thereafter the inlet valve 23 is closed and the pressure fluid that has entered the upper part 19 of the cylinder volume is allowed to expand, whereupon the actuator piston disc 17 continues its movement downward. When the pressure fluid in the upper part 19 of the cylinder volume is not capable of displacing the actuator piston disc 17 further, i.e. when the pressure on the lower side of the actuator piston disc 17 and the return spring of the first engine valve 8 is as high as the pressure on the upper side of the actuator piston disc 17, the actuator piston disc 17 stops. The actuator piston disc 17 is kept in place (is locked) in its lower position a desired amount of time by the emptying valve 27 of the hydraulic circuit 25 being kept closed at the same time as the non-return valve 26 of the hydraulic circuit 25 is closed automatically. In order to provide a return movement the outlet valve 24 is opened to admit an evacuation of pressure fluid from the upper part 19 of the cylinder volume, and additionally the emptying valve 27 of the hydraulic circuit 25 is opened, whereupon the actuator piston disc 17 is displaced upwards when the hydraulic fluid is evacuated from the hydraulic circuit 25, and at the same time pressure fluid is evacuated from the upper part 19 of the cylinder volume to the cylinder head chamber 13.

Figure 3:
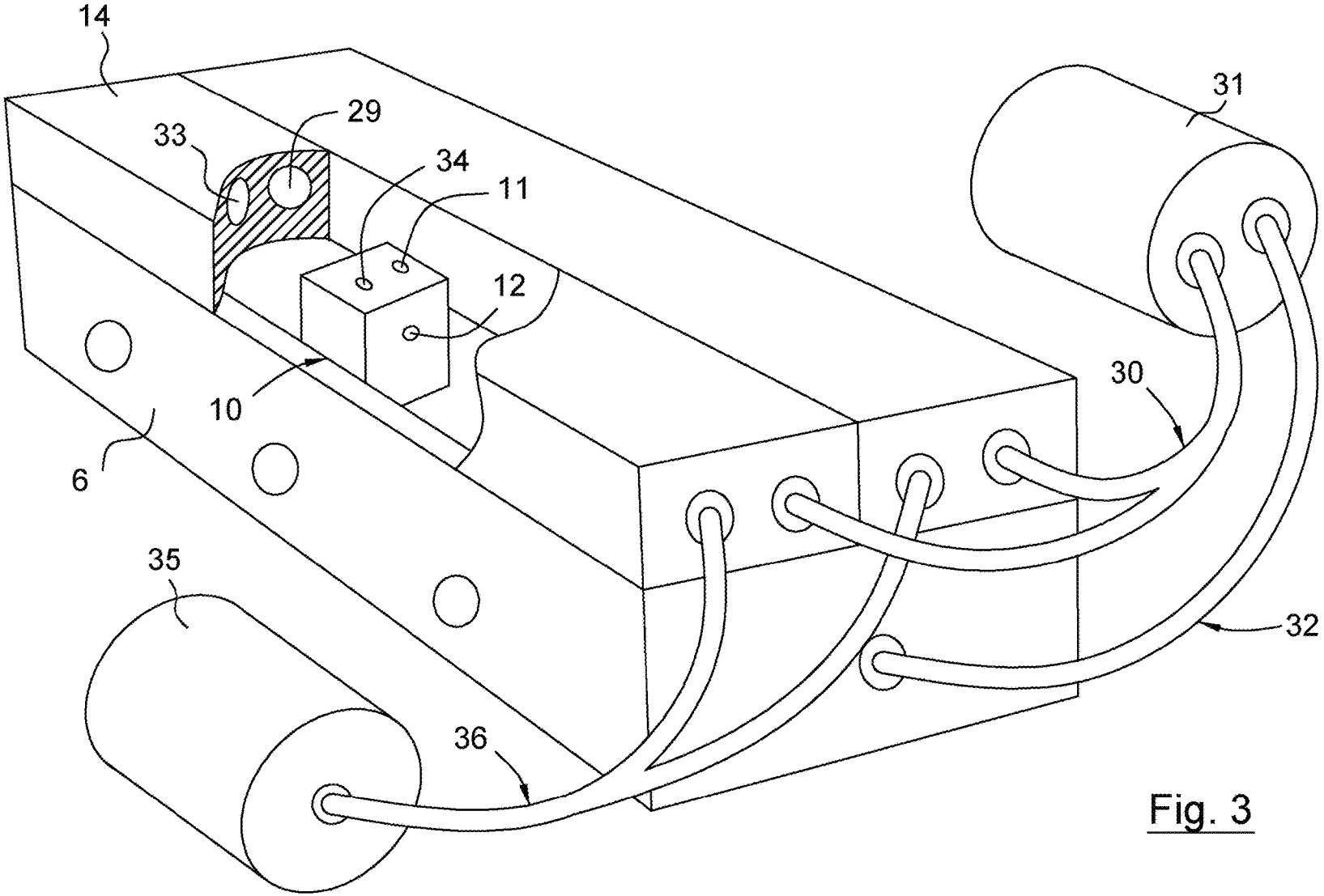
FIG. 3 is a partly cross-sectional schematic perspective view of a cylinder head and cylinder head mantles.

Reference is now primarily made to FIG. 3, which disclose a schematic partly cross sectional perspective view of among other things a cylinder head and cylinder head mantles.

The cylinder head mantle 14 comprises a pressure fluid manifold 29 that is connected to the at least one inlet opening 11 of the valve actuator 10. The pressure fluid manifold 29 extends along the axial length of the cylinder head mantle 14. Said pressure fluid manifold 29 forms part of a primary pressure fluid channel 30 that extends from a compressor 31 to the at least one inlet opening 11 of the valve actuator 10. The compressor 31 is arranged to supply a pressure fluid under high pressure to the valve actuators. Furthermore, a secondary pressure fluid channel 32 (see also FIG. 1) extends from the cylinder head chamber 13 to said compressor 31.

The volume of the primary pressure fluid channel 30, high pressure side, shall be kept as small as possible so that the temperature of the pressure fluid will sink as little as possible from the compressor 31 to the valve actuator 10. The volume of the cylinder head chamber 13 and the secondary pressure fluid channel 32, low pressure side, shall on the other hand be maximized so that the pressure ratio between the low pressure side and the high pressure side is affected as little as possible when the compressor 31 pulls air from the low pressure side. Preferably, the volume of the cylinder head chamber 13 and the secondary pressure fluid channel 32 is at least ten times greater than the volume of the primary pressure fluid channel 30, most preferably at least fifteen times greater.

The compressor 31 has preferably variable compressor volume/displacement, or by other means adjustable outflow, and generally the compressor 31 is driven by the crank shaft of the combustion engine 1. At high numbers of revolutions and high torque output, higher pressure of the pressure fluid in the primary pressure fluid channel 30 is required, and at low numbers of revolutions and low torque output, lower pressure of the pressure fluid in the primary pressure fluid channel 30 is required. The pressure difference between the high pressure side and the low pressure side being in the order of 15-20 bar at high engine speeds and high engine load/torque output and in the order of 2-5 bar at low engine speeds and low engine load. Preferably the compressor 31 is of the type axial piston pump, English term "swashplate", which accomplish variable displacement by means of several pistons having variable stroke wherein all pistons are arranged in mutually different positions in their respective cycle. The stroke is determined by the inclination of a glide plate, which acts against and by rotation drive the pistons to perform an axial movement, and the centre axis of which perform a nutating motion. For each turn of the glide plate all pistons perform one cycle. Thus, the inclination of the glide plate is variable/controllable.

The pressure level on the high pressure side in in the order of 8-30 bar to, with sufficient speed, open an inward opening engine valve where a high counter pressure is present in the combustion chamber, and the pressure level on the low pressure side is in the order of 4-8 bar to hold the pressure ratio below 1:4, preferably below 1:3. The aim is to hold the temperature of the pressure fluid in the primary pressure fluid channel 30 below 120° C. during normal operation for avoiding oxidizing a hydraulic fluid mist that is present in the pressure fluid, however temperatures up to 150° C. can be allowed for short/limited periods.

The cylinder head mantle 14 further comprises a hydraulic liquid manifold 33 that is connected with an inlet opening 34 of said hydraulic circuit 25 of the valve actuator 10. The hydraulic liquid manifold 33 extends along the axial length of the cylinder head mantle 14, parallel to the pressure fluid manifold 29. A pump 35, or the like, is arranged to supply a pressurized hydraulic liquid to the hydraulic liquid manifold 33 via a conduit 36. The cylinder head mantle 14 further comprises all necessary electric infrastructure (not shown) for, among other things, controlling the valve actuator 10, for various sensors, etc.

A disclosure of the invention will now be made with reference to FIGS. 4-10, which disclose alternative embodiments of the return spring arrangement of the first engine valve 8.

Figure 4:
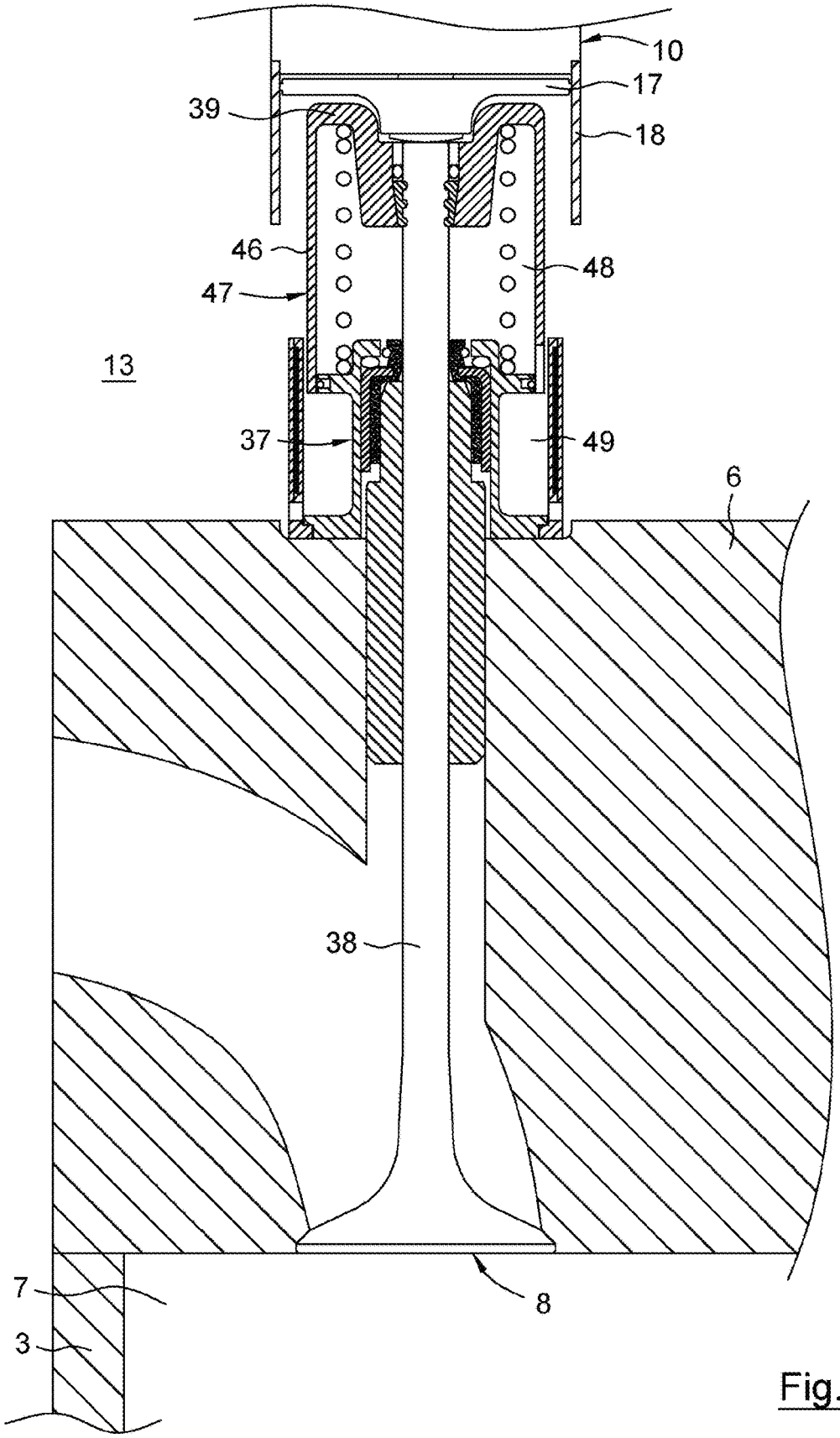
FIG. 4 is a schematic cross-sectional side view of an engine valve and associated return spring arrangement according to a first embodiment.
Figure 5:
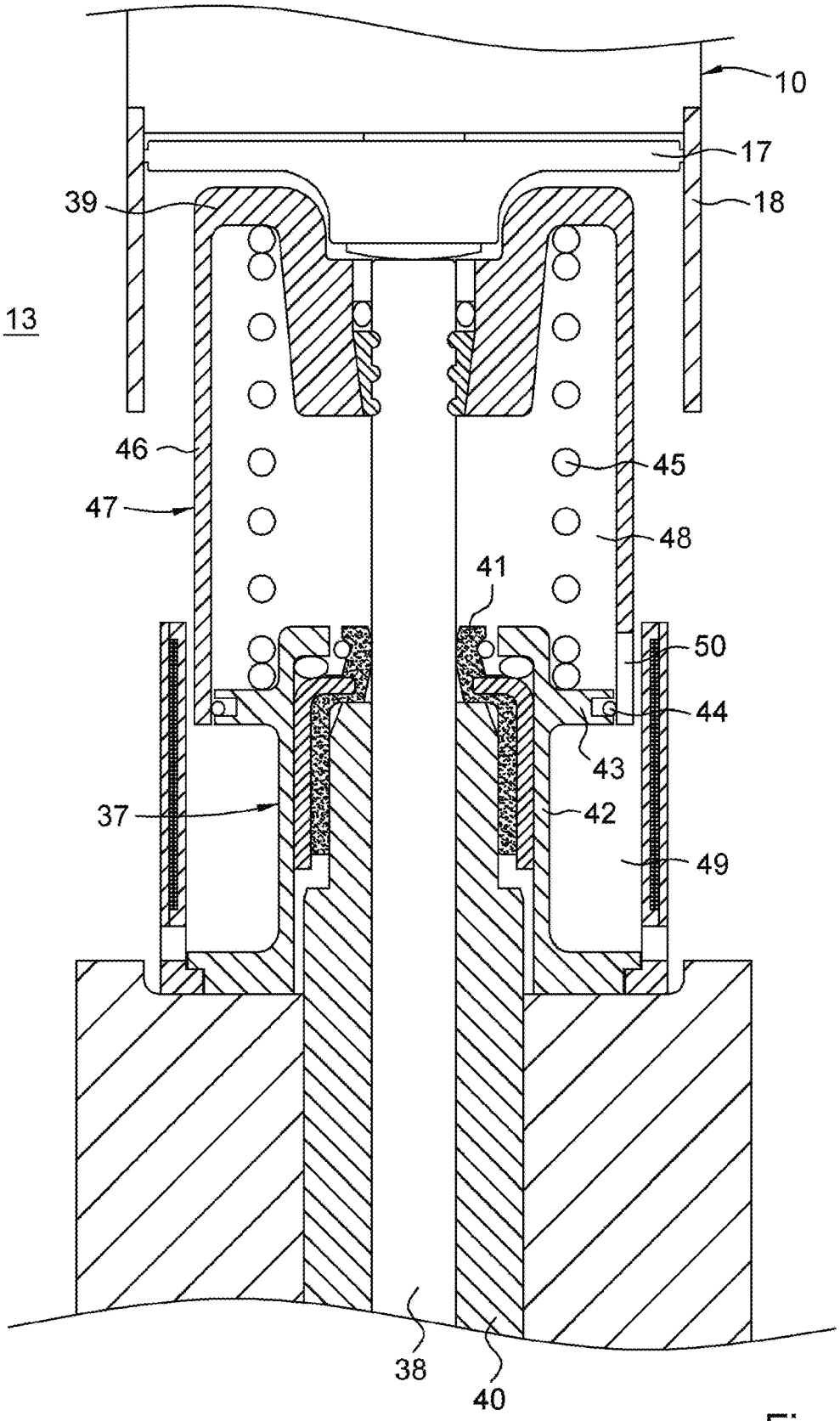
FIG. 5 is an enlargement of a part of FIG. 4 disclosing the return spring arrangement.

Reference is initially made to FIGS. 4 and 5, which disclose a first embodiment of the return spring arrangement of the first engine valve 8.

The cylinder head 6 comprises in the shown embodiment a lead through, generally designated 37, said lead through being arranged to guide a valve stem 38 of the engine valve 8. The engine valve 8 is axially displaceable in relation to said lead through 37, and in relation to the cylinder head 6, between a the combustion chamber 7 closed position and a the combustion chamber 7 fully open position. When the combustion chamber 7 is open fluid communication is allowed, past the engine valve 8, between the combustion chamber 7 and an air supply system or alternatively an air evacuation system/exhaust fumes system. A valve spring retainer 39 is in a conventional way connected to the valve stem 38 at an opposite side of the cylinder head 6 in relation to the combustion chamber 7. The valve spring retainer 39 is preferably arranged in the area of the end of the valve stem 38.

Said lead through 37 project preferably upwards from the cylinder head 6, in the direction away from the combustion chamber 7. The lead through 37 comprises in the shown embodiment an inner guide sleeve 40, that is arranged inserted into the cylinder head 6 and that directly enclose the valve stem 38 of the engine valve 8, a sealing 41 arranged abutting the valve stem 38 and the inner guide sleeve 40, as well as an outer guide sleeve 42 that at least partly enclose the inner guide sleeve 40. The outer guide sleeve 42 is sealed in relation to the inner guide sleeve 40 and/or in relation toe the cylinder head 6. The outer guide sleeve 42 is preferably located at the upper side of the cylinder head 6. In an alternative embodiment the inner guide sleeve and the outer guide sleeve is one and the same element. Preferably the outer guide sleeve 42 comprises, at a distance from the cylinder head 6, a radially extending flange 43, which comprises a sealing 44 in the outer edge thereof. The sealing 44 is preferably an annular sealing for instance manufactured from metal, rubber or plastic.

Between the valve spring retainer 39 and the lead through 37, in the shown embodiment the radially extending flange 43 of the outer guide sleeve 42 of the lead through 37, is a coil spring 45 arranged and extends, said coil spring being arranged to keep the engine valve 8 in its closed position when no forces acts to open it. The coil spring 45 shall be designed to be able to hold the weight of the engine valve 8 and of the elements that are displaceable together with the engine valve 8, and to secure that the engine valve 8 is closed at low engine valve lifts, thereto the spring coefficient of the coil spring 45 shall be as minimal as possible in order not to add force when the engine valve 8 is opened. The biasing force of the coil spring 45 shall preferably be in the order of 100N±20N and the spring coefficient of the coil spring 45 preferably corresponding an added force in the order of 5-10N per compressed millimeter, i.e. per each millimeter the engine valve 8 is displaced.

In the disclosed embodiment said valve spring retainer 39 and a cylinder shaped sleeve 46 extending from the valve spring retainer 39 together forms a valve spring cover, generally designated 47. The cylinder shaped sleeve 46 of the valve spring cover 47 is telescopically displaceable in relation to said lead through 37, radially outside the lead through 37. The valve spring cover 47, the lead through 37 and the engine valve 8 are preferably concentric to each other. In the disclosed embodiment the cylinder shaped sleeve 46 of the valve spring cover 47 is telescopically displaceable radially outside the outer guide sleeve 42, and the ring sealing 44 at the radially extending flange 43 is arranged abutting the inner side of the cylinder shaped sleeve 46. The valve spring cover 47 and the lead through 37 delimit a gas spring volume 48, the volume of which decrease when the engine valve 8 is opened and the valve spring cover 47 is displaced in the axial direction downwards. The valve spring cover 47 is preferably arranged in the cylinder head chamber 13. By using a pneumatic return spring arrangement for the engine valve 8 a small return spring force is obtained at low engine valve lifts and a high return spring force is obtained at high engine valve lifts, however the total power consumption for opening the engine valve 8, at any engine valve lift, is reduced in relation to a return spring arrangement having solely a mechanical return spring. It shall be pointed out that the sealing 44 between the cylinder shaped sleeve 46 and the outer guide sleeve 42 does not need to be absolutely tight, entailing that a simpler and cheaper sealing arrangement can be used, such as a piston ring sealing.

Essential for the present invention is that the gas spring volume 48 is in fluid communication with an adjacent gas volume 49 when the engine valve 8 is in the combustion chamber 7 closed position, and is separated from the adjacent gas volume 49 when the engine valve 8 is in the combustion chamber 7 fully open position.

Thus, when the engine valve 8 is closed the same pressure is present in the gas spring volume 48 as in the adjacent gas volume 49, and when the engine valve 8 is displaced a distance towards the fully open position the fluid communication is closed and the pressure in the gas spring volume 48 increase concurrently with the engine valve 8 and the valve spring cover 47 being displaced downwards. Preferably the adjacent gas volume 49 is part of the cylinder head chamber 13. Thereto, a port 50 is arranged between the gas spring volume 48 and the adjacent gas volume 49.

In a preferred embodiment the cylinder shaped sleeve 46 of the valve spring cover 47, close to its free end, present said port 50 for admitting fluid communication between the gas spring volume 48 and the adjacent gas volume 49 when the engine valve 8 is closed. The port 50 is preferably constituted by one or more recesses in the lower edge of the cylinder shaped sleeve 46. The total/aggregate extension of the port 50 in the circumferential direction preferably correspond to less than 180 degrees and more than 10 degrees, and can be divided in one or more segments. Preferably the total extension of the port 50 corresponds to more than 80 degrees and less than 100 degrees. In an alternative embodiment the recesses of the port 50 are arranged at a small distance from the lower rim of the cylinder shaped sleeve 46. The port 50 is closed gradually, stepwise or linearly, in connection with the downward displacement of the valve spring cover 47.

It is essential that the port 50 is open during a large part of the maximum stroke of the engine valve 8 and is completely closed only when the valve spring cover 47 has been displaced at least 25 percentage of the maximum stroke of the engine valve 8, which in the disclosed embodiment correspond to a displacement of about 3 millimeters, and the port 50 is closed due to a displacement of the engine valve 8.

Preferably said port 50 is open during at least 35 percentage of the maximum stroke of the engine valve 8, most preferably at least 45 percentages. Preferably the port 50 is open during a maximum of 70 percentage of the maximum stroke of the engine valve 8, most preferably a maximum of 60 percentages.

When the engine valve 8 is fully opened the pressure in the gas spring volume 48 shall be less than four times greater than the basic pressure in the gas spring volume 48 when fluid communication is admitted between the gas spring volume 48 and the adjacent gas volume 49, preferably the pressure increase shall not be greater than three times. This entail that the temperature in the gas spring volume 48 does not exceed the temperature at which the hydraulic liquid in the gas spring volume 48 oxidize. At a normal maximum stroke of the engine valve 8 of twelve millimeters, the first part of the displacement of the engine valve 8 is performed without compression of the gas in the gas spring volume 48 due to the port 50 being open, for instance until the engine valve 8 has been displaced six millimeters, i.e. the compression is postponed but give strong progressivity at large/high valve lifts, for instance six-twelve milli-meters. The postponement of the compression entails that the volume of the gas spring volume 48 can be minimized in relation to a system in which the compression is taking place during the entire valve lift. This entail that the temperature in the gas spring volume 48 will not exceed the temperature at which the hydraulic mist in the gas spring volume 48 oxidize. It shall be pointed out that a certain amount of gas will remain in the gas spring volume 48 during operation of the combustion engine, and this gas will be cooled down via the valve spring cover 47, which contributes to admit a higher compression ratio, which in its turn result in a more compact return spring arrangement.

Due to the fact that the port 50, in the disclosed embodiment, is located at the lower end of the gas spring volume 48 any hydraulic liquid accumulated in the gas spring volume 48 when the engine valve 8 has been opened will be evacuated in connection with the next opening of the port 50. The hydraulic liquid evacuated from the gas spring volume 48 flow out due to gravity into the adjacent gas volume 49 and is drained away therefrom in any suitable manner, for instance via a controllable valve. In the case the adjacent gas volume 49 is part of the cylinder head chamber 13, the hydraulic liquid preferably flow into the cylinder head chamber 13 and is preferably drained away therefrom via a controllable valve (not shown).

Figure 6:
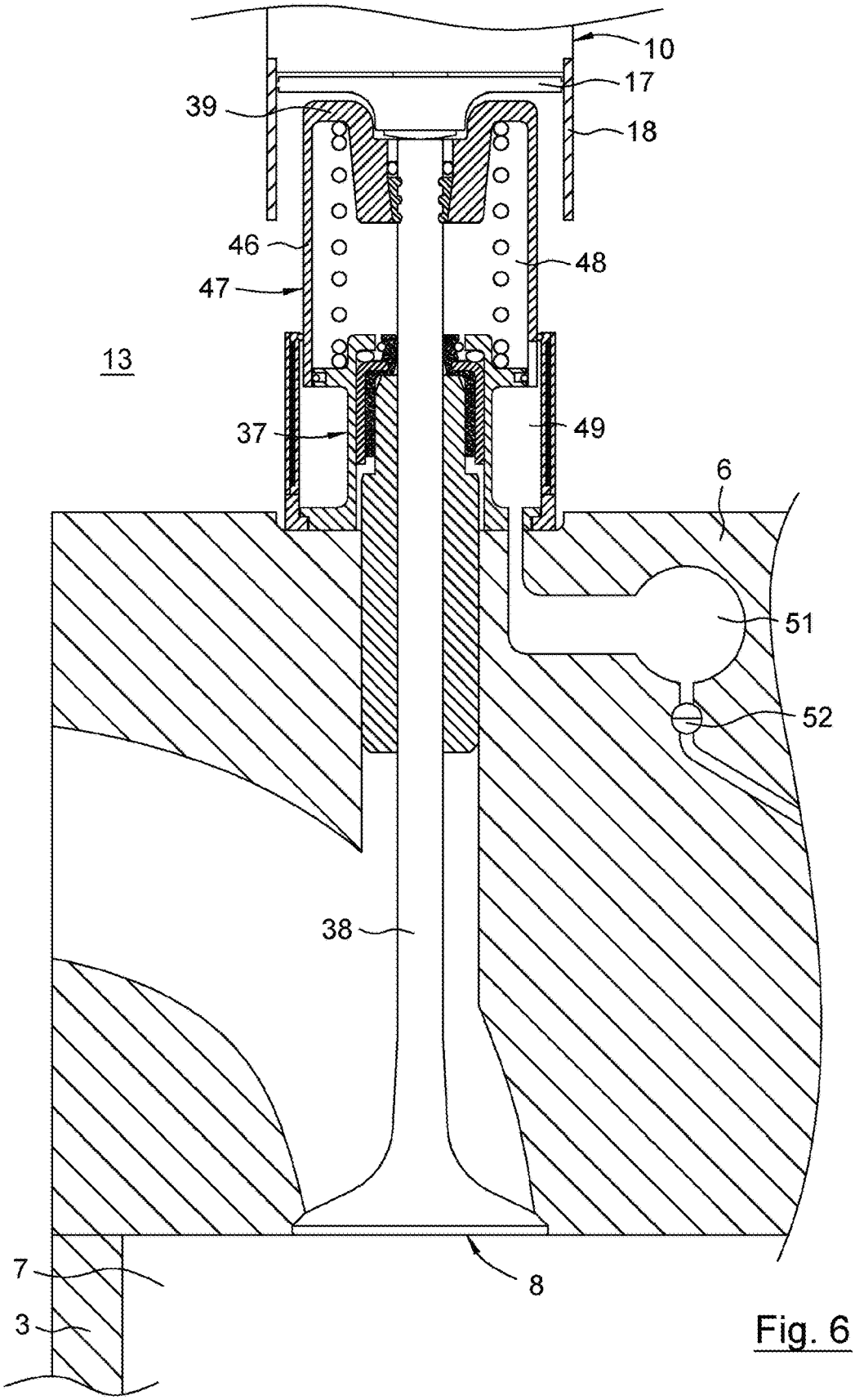
FIG. 6 is a schematic cross-sectional side view of an engine valve and associated return spring arrangement according to a second embodiment.
Figure 7:
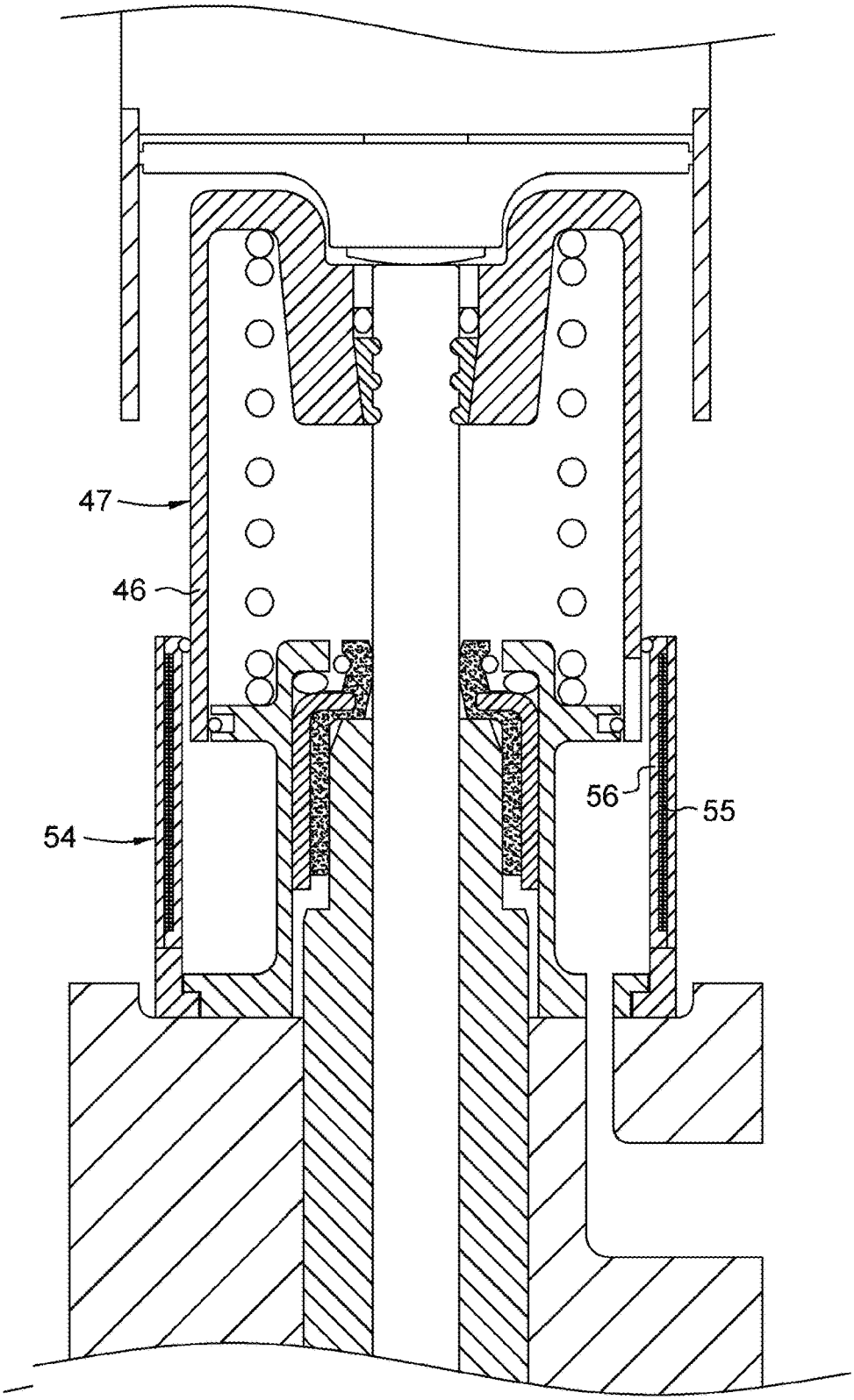
FIG. 7 is an enlargement of a part of FIG. 6 disclosing the return spring arrangement.

Reference is now primarily made to FIGS. 6 and 7 which disclose a second embodiment of the return spring arrangement of the first engine valve 8. Only parts different from the first embodiment according to FIGS. 4 and 5 will be described.

In this embodiment the adjacent gas volume 49 is separated from the cylinder head chamber 13 and instead in fluid communication with a gas spring manifold 51 arranged in the cylinder head 6. The gas spring manifold 51 extend along the axial length of the cylinder head 6. The gas spring manifold 51 preferably comprises a hydraulic liquid drainage valve 52, which is controlled to drain away accumulated hydraulic liquid to the hydraulic liquid sump of the combustion engine 1. Preferably the pressure in the gas spring manifold 51 is higher than the pressure in the cylinder head chamber 13 and preferably less than 2 bar higher pressure. The pressure in the gas spring manifold 51 is adjustable in line with the present operation of the combustion engine 1. By using a gas spring manifold 51 the basic pressure in the gas spring volume 48 may be adjusted in line with the present situation independently from the pressure in the cylinder head chamber 13 and independently from the pressure ratio in the closed pressure fluid circuit. Thereto it is possible in this embodiment to entirely eliminate the coil spring 45, alternatively use a weaker coil spring having much less pretension force and less spring coefficient.

In yet another embodiment, not shown, of the return spring arrangement of the first engine valve 8, the gas spring manifold 51 constitute the adjacent gas volume whereupon a valve is located between the gas spring volume 48 and the gas spring manifold 51. The valve is for instance constituted by a non-return valve admitting passage from the gas spring manifold 51 to the gas spring volume 48, and thus the return spring arrangement present a one-way fluid communication between the gas spring manifold 51 and the gas spring volume 48 when the engine valve 8 is closed.

Figure 8:
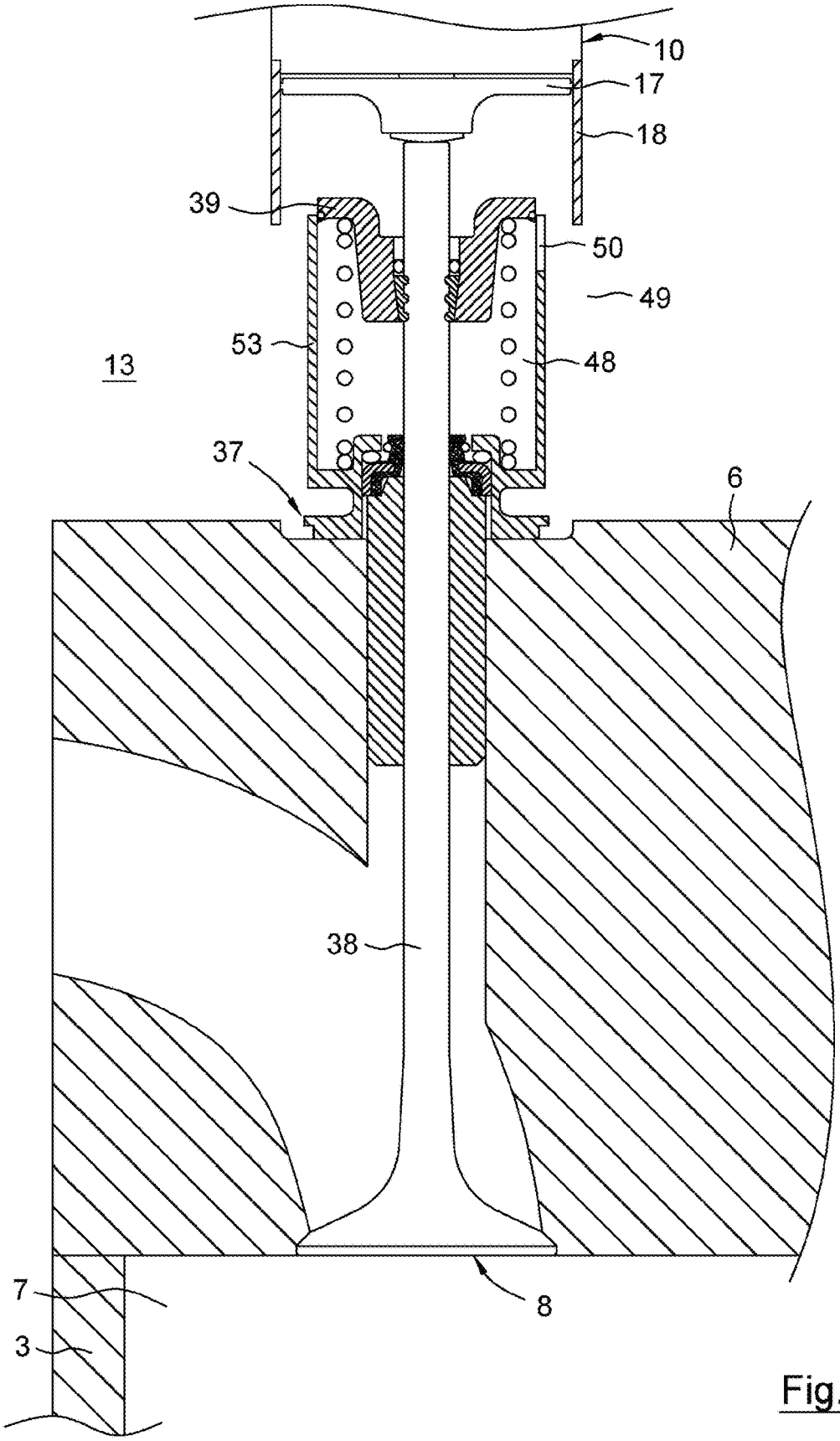
FIG. 8 is a schematic cross-sectional side view of a return spring arrangement according to a third embodiment.

In an alternative embodiment, not shown, the gas spring manifold 51 is connected directly to the inlet pipe of the combustion chamber 7 if the engine valve is an inlet valve, and directly connected to the outlet pipe of the combustion chamber 7 of the engine valve is an exhaust valve, thereby the same pressure is present in the gas spring volume 48 as the pressure acting to open the engine valve 8. Reference is now made to FIG. 8, which disclose a third embodiment of the return spring arrangement of the first engine valve 8. Only parts different from the other embodiments will be described.

Also in this embodiment the valve spring retainer 39 is connected to the valve stem 38 of the engine valve 8, however no cylinder shaped sleeve is connected to the valve spring retainer 39. Instead a cylinder shaped sleeve 53 project in the direction away from the cylinder head 6, the cylinder shaped sleeve 53 being sealed against the valve stem 38 in the area of the lower edge of the cylinder shaped sleeve 53. Preferably the cylinder shaped sleeve 53 is part of the lead through 37. The valve spring retainer 39 is axially displaceable internally of the cylinder shaped sleeve 53, the valve spring retainer 39 and the cylinder shaped sleeve 53 delimiting the gas spring volume 48. The port 50 is arranged in connection with the upper edge of the cylinder shaped sleeve 53, however the function and the characteristics of the port 50 is the same as described above.

Figure 9:
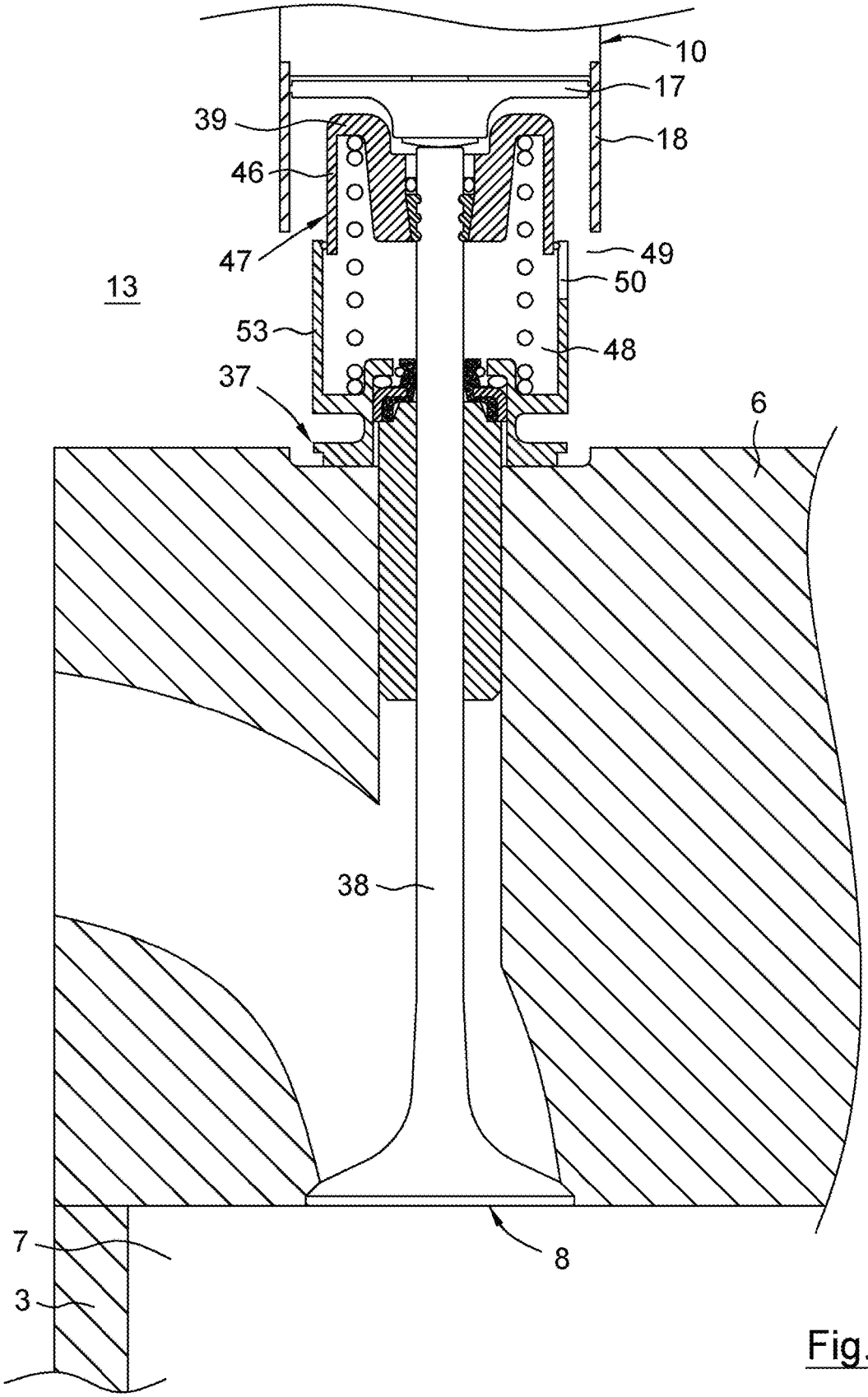
FIG. 9 is a schematic cross-sectional side view of the return spring arrangement according to FIG. 8 according to an alternative embodiment.

Reference is now made to FIG. 9, disclosing an alternative to the embodiment according to FIG. 8. In this alternative embodiment the return spring arrangement comprises a valve spring cover 47, as the embodiments according to FIGS. 4-7, having a valve spring retainer 39 and a cylinder shaped sleeve 46 extending from the valve spring retainer 39. The cylinder shaped sleeve 46 of the valve spring cover 47 is telescopically displaceable, radially inside or outside, in relation to the cylinder shaped sleeve 53 extending from the cylinder head 6. The port 50 is in the disclosed embodiment arranged in the upper edge of the upwards projecting cylinder shaped sleeve 53, however the port may alternatively be arranged in the lower edge of the cylinder shaped sleeve 46 of the valve spring cover 47, or a combination thereof.

Reference is now primarily made to FIG. 7 without being delimited to the embodiment of the return spring arrangement of the engine valve 8 according to FIG. 7. The combustion engine 1 comprises preferably a position sensor 54, that comprises said valve spring cover 47 and a coil 55, the valve spring cover 47 being telescopically displaceable in relation to the coil 55, radially inside the coil 55. The coil 55, or inductor, is arranged radially outside of the part of the lead through 37 that extend from the cylinder head 6.

The purpose of the position sensor 54 is to use individual digital input signal pulses as well as individual output signal pulses originated therefrom, allowing the possibility to determine the mutual position between the valve spring cover 47 and the coil 55 by high time and location resolution as well as low power consumption.

Due to the fact that the valve spring cover 47 is jointly displaceable with the engine valve 8 and the coil 55 being connected to the cylinder head 6, a determination of the mutual position between the valve plate of the engine valve 8 and the valve seat of the engine valve 8 in the cylinder head 6 is obtained, i.e. a determination of the location of the engine valve 8 and by which degree the valve is open, or in other words the present valve lift.

The cylinder shaped sleeve 46 of the valve spring cover 47 is constituted by an electrically conductive body, preferably manufactured from a non-magnetic metal, such as aluminum. However, it is feasible that the cylinder shaped sleeve 46 is manufactured from a magnetic metal, such as a compressed iron powder body. The coil 55 is preferably manufactured from cupper and is winded onto a carrier 56. The coil 55 is operatively connected to a logic circuit (not shown), and the position sensor is adapted to operate in the following way. When the engine valve 8 is displaced in relation to the valve seat, in order to let in or out gas from the combustion chamber 7, also the gas spring cover 47 is displaced in relation to the coil 55. When the overlap between the cylinder shaped sleeve 46 of the gas spring cover 47 and the coil 55 increases, the time elapsed for a measuring voltage over a resistance that is connected in series with the coil 55 to be changed a predetermined value decreases in proportion the overlap, as a consequence of the coil 55 being short-circuited to different degrees by the impact from the cylinder shaped sleeve 46 of the gas spring cover 47. The measuring voltage across the resistance is changed when the voltage across the coil 55 is changed, and the voltage across the coil 55 is changed when it is requested to determine the mutual position.

The determination of the mutual position between the engine valve 8 and its valve seat can be selected to only be made when there is a reason to determine the mutual position, i.e. when the engine valve 8 is in motion. The motion of the engine valve 8 is based on the crankshaft motion of the combustion engine 1, and is in a normal combustion engine in motion during approximately a ½ turn of a full revolution of crankshaft. During the period of time the engine valve 8 is in motion, the determination of the position of the engine valve 8 preferably is made once per crank angle degree, i.e. approximately 90-180 times during one revolution of the crankshaft.

Figure 10:
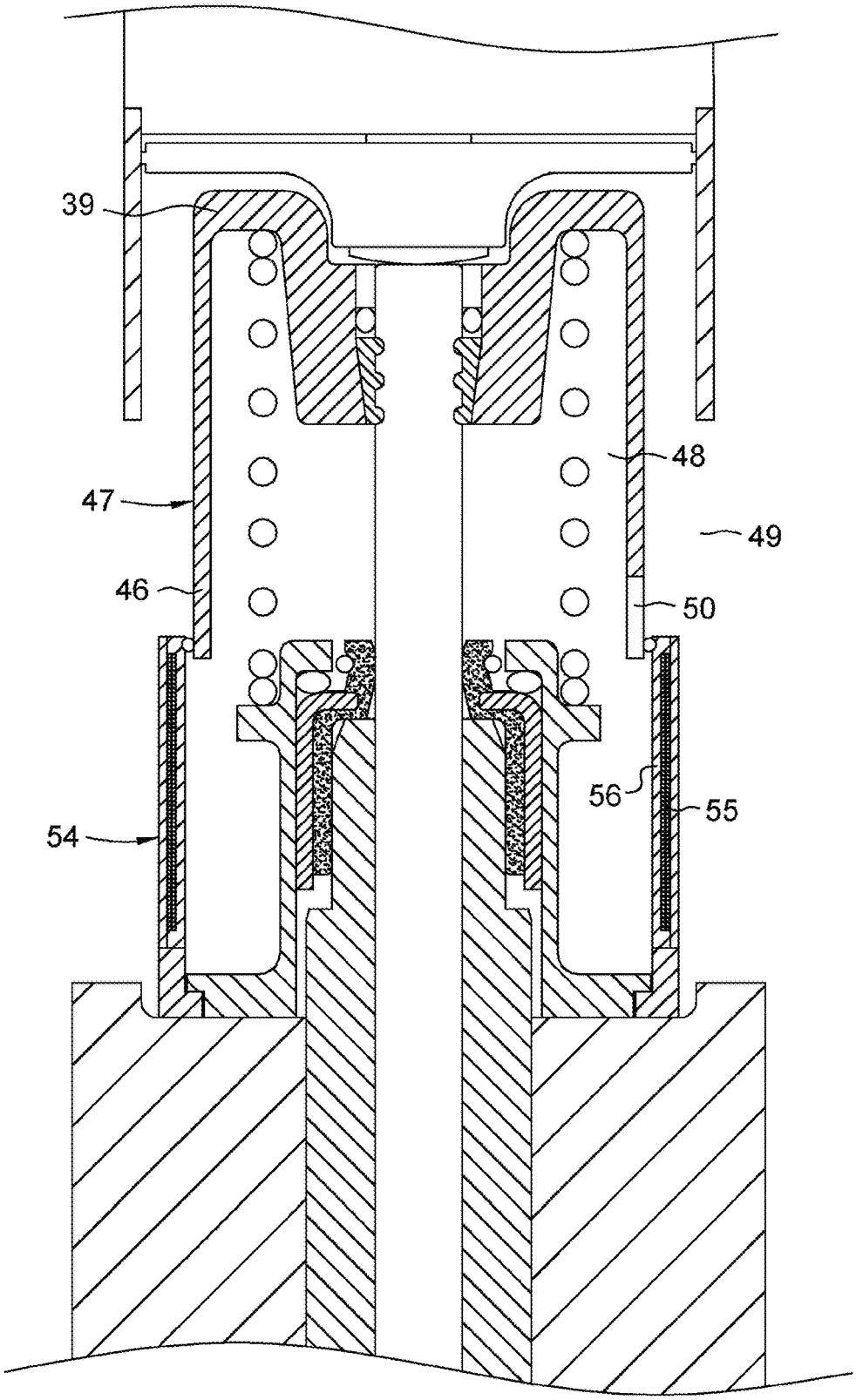
FIG. 10 is a schematic cross-sectional side view of a return spring arrangement according to a forth embodiment.

Reference is now primarily made to FIG. 10, which disclose a forth embodiment of the return spring arrangement of the engine valve 8. Only parts different from the other embodiments will be described.

The embodiment according to FIG. 10 is an alternative to the embodiment according to FIG. 9, in which the cylinder shaped sleeve extending from the cylinder head 6 is exchanged with the position sensor 54. The port 50 is in this embodiment arranged in the lower edge of the cylinder shaped sleeve 46 of the valve spring cover 47.

Feasible Modifications of the Invention

The invention is not limited to only the abovementioned and embodiments shown in the drawings, which only have an illustrating and exemplifying purpose. This patent application is intended to cover all modifications and variants of the preferred embodiments described herein, and the present invention is consequently defined by the wording of the enclosed claims and its equivalents. Thus, the equipment can be modified in all conceivable ways within the framework of the enclosed claims.

It should also be pointed out that all information about/concerning terms such as above, below, upper, lower, etc. shall be interpreted/read with the equipment oriented in accordance with the figures, with the drawings oriented in such a way that the reference numbers can be read in a correct manner. Consequently, such terms indicates only relative relationships in the shown embodiments, which relationships can be changed if the equipment according to the invention is provided with another construction/design.

It should be pointed out that even if it is not explicitly stated that features from a specific embodiment can be combined with the features of another embodiment, this should be regarded as obvious when so is possible.

The invention claimed is:

1. A combustion engine, comprising:

a cylinder head (6) adjacent to a combustion chamber (7);

a controllable engine valve (8) including a valve stem (38), the cylinder head (6) arranged to guide the valve stem (38) of the engine valve (8), the engine valve (8) being axially displaceable in relation to said cylinder head (6) between a closed position that closes the combustion chamber (7) and a fully open position that opens the combustion chamber (7); and a valve spring retainer (39) that is connected to said valve stem (38), wherein the valve spring retainer (39) partly delimits a gas spring volume (48), the gas spring volume (48) being in fluid communication with an adjacent gas volume (49) via a port (50) when the engine valve (8) is in the closed position, and the gas spring volume (48) being separated from the adjacent gas volume (49) when the engine valve (8) is in the fully open position, said port (50) being open during at least forty-five percent of a maximal stroke of the engine valve (8).

2. The combustion engine according to claim 1, wherein said port (50) is open during a maximum of seventy percent of the maximal stroke of the engine valve (8).

3. The combustion engine according to claim 1, wherein the cylinder head (6) comprises a lead through (37), which is arranged to guide the valve stem (38) of the engine valve (8), said valve spring retainer (39) and a cylinder shaped sleeve (46) that extends from the valve spring retainer (39) forming a valve spring cover (47) , the cylinder shaped sleeve (46) of the valve spring cover (47) being telescopically displaceable in relation to said lead through (37), radially outside the lead through (37), and the valve spring cover (47) and the lead through (37) delimiting said gas spring volume (48).

4. The combustion engine according to claim 3, wherein the cylinder shaped sleeve (46) of the valve spring cover (47), positioned at a free end thereof, presents said port (50) for admitting fluid communication between the gas spring volume (48) and the adjacent gas volume (49) when the engine valve (8) is in the closed position.

5. The combustion engine according to claim 4, further comprising:

a cylinder head chamber (13) that is part of a closed pressure fluid circuit, and that is partly delimited by said cylinder head (6), the valve spring cover (47) being arranged in said cylinder head chamber (13).

6. The combustion engine according to claim 3, further comprising:

a cylinder head chamber (13) that is part of a closed pressure fluid circuit, and that is partly delimited by said cylinder head (6), the valve spring cover (47) being arranged in said cylinder head chamber (13).

7. The combustion engine according to claim 6, wherein a valve actuator (10) is operatively connected to said engine valve (8), said valve actuator (10) being arranged in said closed pressure fluid circuit.

8. The combustion engine according to claim 7, wherein said valve actuator (10) is arranged in the cylinder head chamber (13).

9. The combustion engine according to claim 6, wherein the adjacent gas volume (49) is part of the cylinder head chamber (13).

10. The combustion engine according to claim 6, wherein the adjacent gas volume (49) is separated from the cylinder head chamber (13) and is in fluid communication with a gas spring manifold (51) arranged in the cylinder head (6).

11. The combustion engine according to claim 10, wherein the gas spring manifold (51) comprises a hydraulic fluid drainage valve (52).

12. The combustion engine according to claim 11, wherein a pressure in the gas spring manifold (51) is higher than a pressure in the cylinder head chamber (13).

13. The combustion engine according to claim 10, wherein a pressure in the gas spring manifold (51) is higher than a pressure in the cylinder head chamber (13).

14. The combustion engine according to claim 3, further comprising:

a position sensor (54) including said valve spring cover (47) and a coil (55), the valve spring cover (47) being telescopically displaceable in relation to the coil (55), radially inside the coil (55).

15. The combustion engine according to claim 1, wherein said port (50) is open during a maximum of sixty percent of the maximal stroke of the engine valve (8).

* * * * *